United States Patent [19]

Rester

[11] 4,189,173

[45] Feb. 19, 1980

[54] LATCH FOR A FIRE SCREEN FOLDING DOOR ASSEMBLY

[75] Inventor: Joe D. Rester, Decatur, Ala.

[73] Assignee: Matthews Machine Co., Inc., Decatur, Ala.

[21] Appl. No.: 899,326

[22] Filed: Apr. 24, 1978

[51] Int. Cl.[2] ..... E05C 19/06

[52] U.S. Cl. ..... 292/86; 49/449; 160/118; 292/91

[58] Field of Search ..... 160/118, 199, 206; 292/91, 86, 87, DIG. 46, 80–85, 88, 89, 303; 49/370, 449

[56] References Cited

U.S. PATENT DOCUMENTS

| | | | |
|---|---|---|---|
| 1,227,590 | 5/1917 | Deindoerfer, Jr. | 292/87 |
| 2,042,297 | 5/1936 | Craiglead | 292/87 |
| 3,101,777 | 8/1963 | Sherron | 160/206 |
| 3,102,582 | 9/1963 | Rudnick | 160/118 X |

FOREIGN PATENT DOCUMENTS

| | | | |
|---|---|---|---|
| 1095708 | 12/1960 | Fed. Rep. of Germany | 160/118 |

*Primary Examiner*—William E. Lyddane

*Attorney, Agent, or Firm*—Woodford R. Thompson, Jr.

[57] ABSTRACT

A latch for a fire screen folding door assembly having a projecting guide adjacent its inner edge adapted to move in a horizontal guideway in a supporting frame. A latch element carried by the frame is movable selectively to a first position in the path of movement of the guide and to a second position out of the path of movement of the guide. The latch element is resiliently held in its first position until the guide engages the latch element and moves the same to its second position. A recess in the latch element receives the guide upon movement of the door assembly to extended, closed position permitting the latch element to return to its first position and thereby secure the door assembly in closed position. An actuator is connected to the latch element for moving the latch element to a position to release the guide.

4 Claims, 9 Drawing Figures

FIG. 1
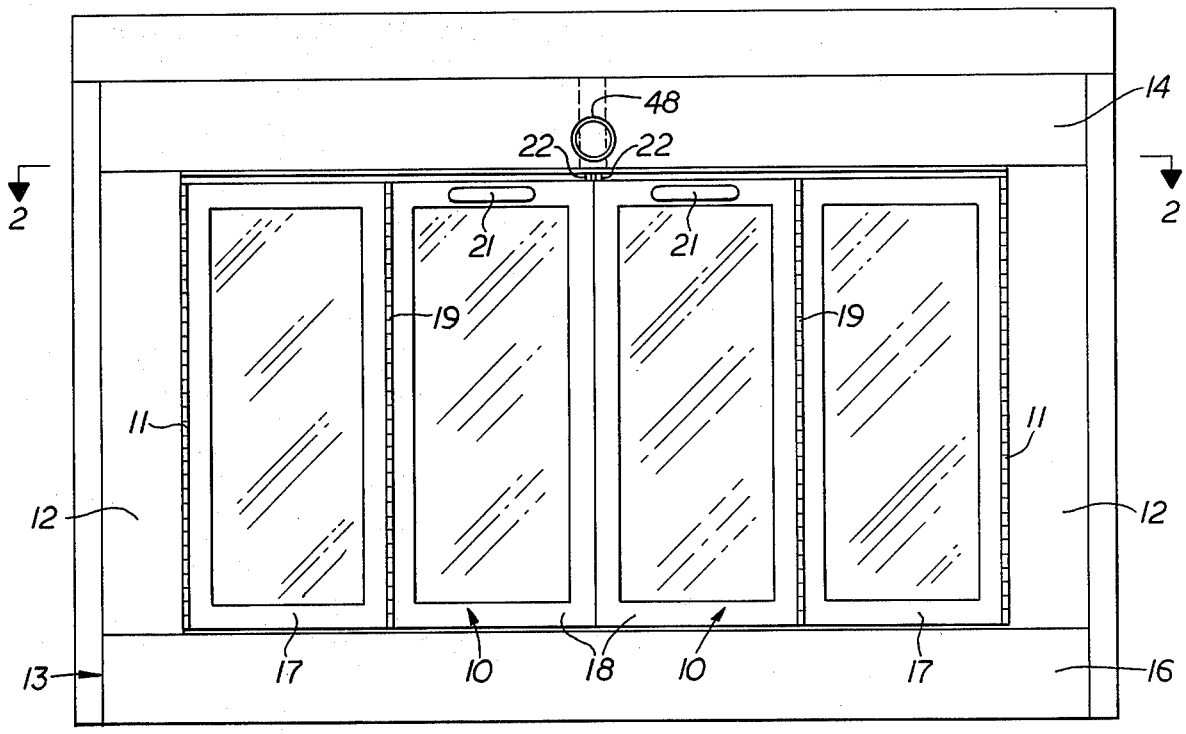
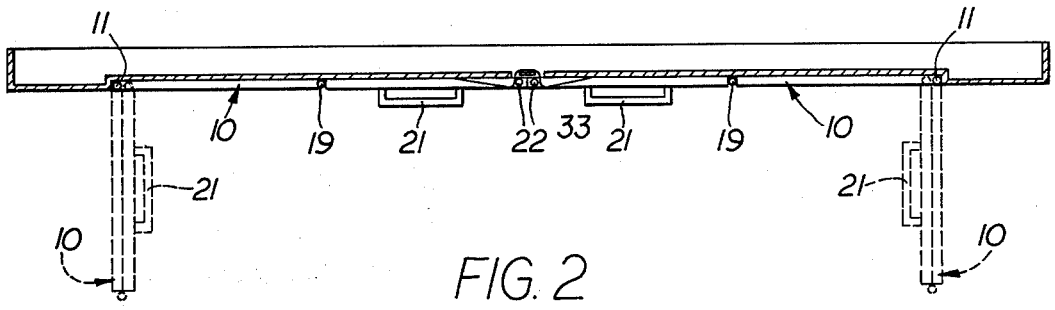
FIG. 2
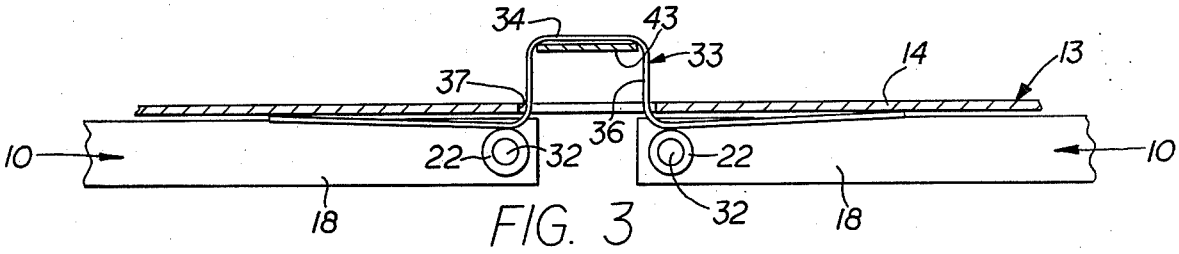
FIG. 3
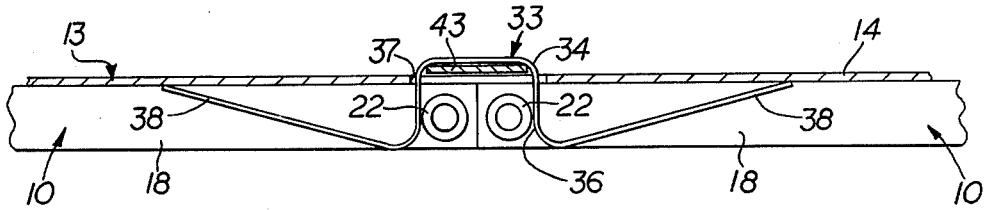
FIG. 4

LATCH FOR A FIRE SCREEN FOLDING DOOR ASSEMBLY

BACKGROUND OF THE INVENTION

This invention relates to a latch for a fire screen folding door assembly and more particularly to such a latch which positively secures the door assembly in closed position until the latch is released, thereby providing safety for children and safety from the fire. That is, the door assembly cannot be accidentally opened or opened by children due to the fact that an actuator member must be positively moved from a locked position to a release position before the door assembly can be opened.

Heretofore in the art to which my invention relates, fire screen folding door assemblies have been retained in closed position by providing bendable clips on the folding doors in position to engage the supporting frame as the doors are moved to extended, closed position. Such retaining clips do not provide positive means for retaining the doors in closed position due to the fact that the clips wear or are distorted in use whereby they fail to retain the door assembly in closed position at all times. This is especially true in view of the fact that such prior art doors are opened by merely overcoming the frictional engagement of the clips with the surface adjacent thereto. Also, fire screen folding door assemblies with which I am familiar are complicated in structure whereby they are expensive to manufacture and are very difficult to assemble.

SUMMARY OF THE INVENTION

In accordance with my invention, I overcome the above and other difficulties by providing a positive latch assembly which secures the door assembly in closed position at all times until released, thereby preventing the doors from opening accidentally and also preventing the doors from being opened by children. In accordance with my invention I provide a latch element on the supporting frame for the folding door assembly with the latch element being adjacent the inner edge of the door assembly and being movable selectively to a first position in the path of movement of a guide member carried by the inner portion of the door and to a second position out of the path of movement of the guide member. The latch element is resiliently held in its first position until the guide member engages the latch element and moves the same to its second position. A recess is provided in the latch element in position to receive the guide member upon movement of the door assembly to extended, closed position whereby the latch element returns to its first position and thus secures the door assembly in closed position.

DESCRIPTION OF THE DRAWINGS

Latch units for fire screen folding door assemblies are shown in the accompanying drawings, forming a part of this application, in which:

FIG. 1 is a front elevational view showing two folding door assemblies hingedly mounted within an opening in a supporting frame;

FIG. 2 is a sectional view taken generally along the line 2—2 of FIG. 1 with the door assemblies being shown in the extended, closed position in solid lines and being shown in the open, folded position in dotted lines;

FIG. 3 is an enlarged, fragmental, sectional view showing the movable latch element being moved by the guide members out of their path of movement and just prior to movement of the guide members into the locking recess provided in the latch element;

FIG. 4 is a fragmental, sectional view corresponding to FIG. 3 showing the guide members after they have moved into the locking recess in the latch element and showing the latch element returned to its locking position;

DETAILED DESCRIPTION

Figure 6:
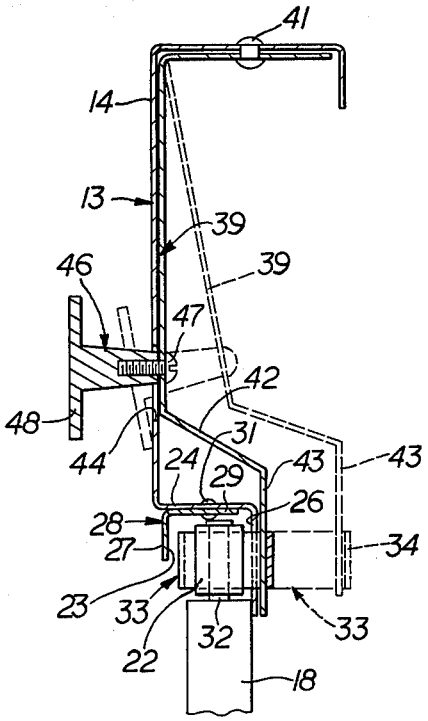
FIG. 6 is a sectional view taken generally along the line 6—6 of FIG. 5.
Figure 5:
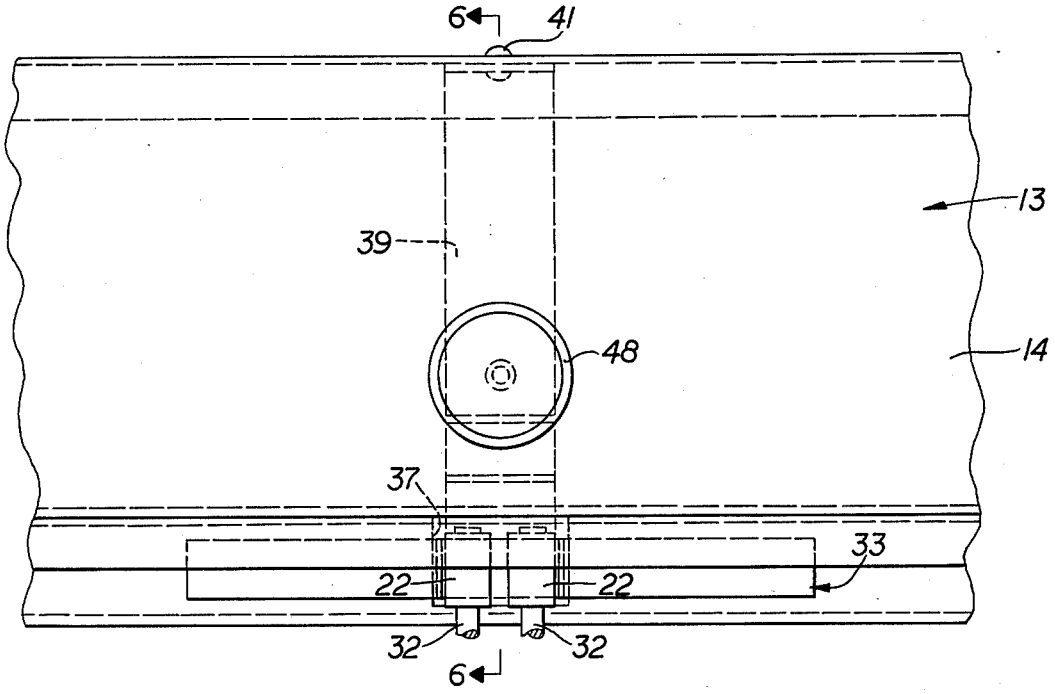
FIG. 5 is an enlarged, fragmental view, partly broken away and in section, showing the latch assembly and its relationship to the folding door assemblies and the supporting frame for the door assemblies.

Referring now to the drawings for a better understanding of my invention, I show two fire screen folding door assemblies 10 hingedly mounted along their outer edges by suitable hinges 11 to vertical side members 12 of a supporting frame 13. The supporting frame 13 is provided with upper and lower panels 14 and 16, respectively, which are connected to the vertical side members 12 to provide a generally rectangular frame having a rectangular opening therein for receiving the door assemblies 10. The supporting frame 13 is adapted to extend across a fireplace opening and is connected to the fireplace by suitable means. In view of the fact that the manner in which fireplace screens are secured in place is well known in the art to which this invention relates, no further description thereof is deemed necessary.

As shown in FIGS. 1 and 2, each folding door assembly 10 is shown as comprising an outer panel 17 and an inner panel 18 with each outer panel 17 being connected to its inner panel 18 by a vertical hinge connection 19. Preferaby, the panels 17 and 18 comprise the usual rectangular frames having glass panels mounted therein whereby the fire may be viewed through the glass panels. Since such panels are well known in the art to which my invention relates, no further description is deemed necessary. Also, each of the door assemblies 10 is provided with a handle 21 adjacent the upper end of the panel 18 for moving the door assemblies 10 selectively to opened and closed position.

A vertically projecting guide member 22 is mounted adjacent the inner edge of each door panel 18 in position to move in a horizontal guideway 23 in the supporting frame 13, as clearly shown in FIG. 6. The guideway 23 may be formed by turning the lower end of the upper panel 14 inwardly to provide a horizontal portion 24 and then downwardly to provide a vertically extending flange 26 which extends alongside the guide member 22. Outward movement of the guide member 22 is limited by a depending flange 27 of an angle bracket 28. The upper flange 29 of the angle bracket 28 is secured to the under surface of the horizontally extending portion 24 by suitable means, such as a rivet 31, whereby the horizontally extending guideway 23 is defined between the depending flanges 26 and 27. Preferably, the guide member 22 is in the form of a roller mounted on a vertical rod 32 mounted adjacent the inner edge of the door panel 18, as shown. It will thus be seen that the guide member 22 rides in the horizontal guideway 23 as each door assembly 10 is moved selectively to an extended, closed position, as shown in solid lines in FIG. 2, and to an open, folded position, as shown in dotted lines in FIG. 2.

My improved latch unit comprises a latch element 33 which is carried by the upper panel 14 of the supporting frame 13 and is adapted for movement selectively to a first position in the path of movement of the guide member 22 along the horizontal guideway 23 and to a second position out of the path of movement of the guide member 22. In FIGS. 1–6, I show the latch element 33 as being in the form of an elongated leaf spring having an offset portion 34 intermediate the ends thereof defining a recess 36 in position to receive each guide member 22 upon movement of the door assembly 10 to the extended, closed position, as shown in FIG. 4. As shown in FIGS. 3 and 4, a passageway 37 is provided in the top panel 14 of the supporting frame 13 for receiving the offset portion 34. The leaf spring defining the latch element 33 is provided with end portions 38 which extend at an angle toward and engage the supporting frame 13 so that the latch element 33 is urged by the end portions 38 toward the position shown in FIG. 4. In this position, the latch element 33 lies in the path of movement of the guide members 22 to thus secure the door assemblies 10 in the closed position. Also, the inclined end portions 38 which extend at an angle to the supporting frame 13 provide sloping surfaces which are engaged by the guide members 22 as the door assemblies 10 move from the open position shown in dotted lines in FIG. 2 to the closed position, as shown in solid lines in FIG. 2. That is, as the guide members 22 engage the sloping end portions 38 they move the intermediate portion of the latch element 33 inwardly toward the supporting frame 13 whereby the offset portion 34 moves to the position shown in FIG. 3. After reaching the recess 36 in the offset portion 34, the guide members 22 move into the recess 36 whereupon the spring action of the end portions 38 then urges the offset portion 34 to the position shown in FIG. 4 with the sides of the recess 36 preventing the guide members 22 from moving toward open position.

While I have shown the recess 36 as being of a width to receive two adjacent guide members 22 carried by the adjacent door assemblies 10, it will be apparent that where a single door assembly 10 is employed, the recess 36 could be of a width to receive only one guide member 22.

To release the latch element 33, I provide an actuator member 39 which is secured to an upper portion of the supporting frame 13, by suitable means, such as a rivet 41. The actuator member 39 is shown as being in the form of a leaf spring which normally rests against the inner surface of the top panel 14, as shown in FIG. 6. The lower portion of the actuator member 39 extends laterally as at 42 and then downwardly to provide a generally vertical portion 43 which extends between the back side and the depending flange 26 and the offset portion 34 of the latch element 33. An opening 44 is provided in the top panel 14 of the supporting frame 13 for receiving a handle member 46 which is secured to the actuator member 39 by a threaded retaining member 47. The outermost portion of the handle 46 is provided with a knob-like member 48 whereby the handle 46 may be pushed inwardly from the solid line position to the dotted line position shown in FIG. 6. Accordingly, upon moving the handle 46 to the dotted line position shown in FIG. 6, the actuator member 39 moves to the dotted line position to thus engage the offset portion 34 of the latch element 33 and move the latch element 33 to the dotted line position shown in FIG. 6 and to the position shown in FIG. 3. In this position, the guide members 22 are free to move relative to the latch element 33 and the supporting frame 14 whereby upon movement of the handles 21 away from each other, the folding door assemblies 10 move away from each other to the open position shown in dotted lines in FIG. 2.

From the foregoing description, the operation of the apparatus shown in FIGS. 1–6 will be readily understood. To move the door assembly 10 from the open, dotted line position shown in FIG. 2 to the closed position shown in solid lines in FIG. 2, the handles 21 are moved toward each other or toward the latch element 33 whereupon the guide members 22 ride in the horizontal guideway 23 toward closed position. As the guide members 22 engage the inclined end portions 38 of the leaf spring defining the latch element 33, the latch element 33 is depressed whereby the offset portion 34 moves from the position shown in FIG. 4 to the position shown in FIG. 3 whereby the guide members 22 move relative to the latch element 33 and then pass into the recess 36. As the guide members 22 move into the recess 36, the spring action of the end portions 38 cause the spring element 33 to move from the position shown in FIG. 3 back to its original position shown in FIG. 4. Since the guide members 22 are then locked within the confines of the recess 36, the door assemblies 10 cannot be moved toward open position without releasing the latch element 33. To release the latch element 33, the handle member 46 is depressed whereby the actuator member 39 moves to the dotted line position shown in FIG. 6 to thereby move the offset portion 34 of the latch element 33 to the dotted line position shown in FIG. 6 and to the position shown in FIG. 3. In this position, the guide members 22 are free to move out of alignment with the recess 36 and then move toward open position as the handle members 21 are moved toward open position.

Figure 9:
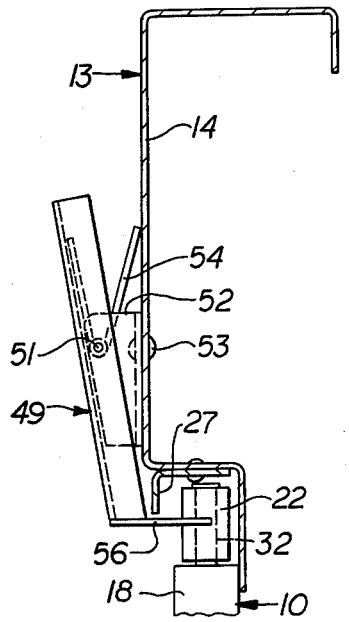
FIG. 9 is a sectional view taken generally along the line 9—9 of FIG. 7.
Figure 8:
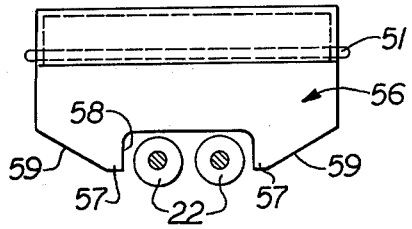
FIG. 8 is a bottom plan view of the latch element taken generally along the line 8—8 of FIG. 7.
Figure 7:
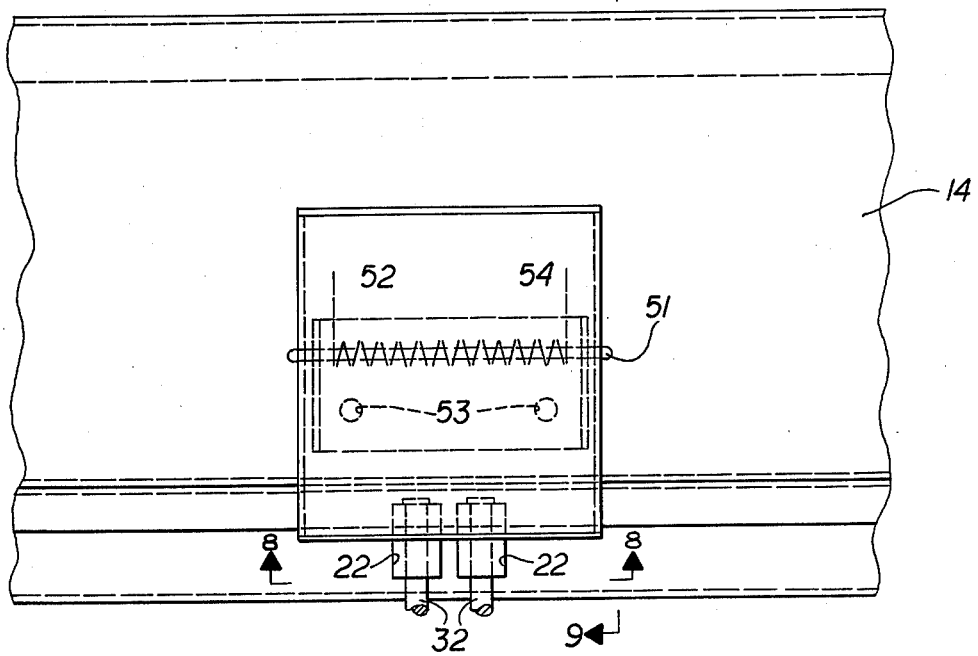
FIG. 7 is a fragmental view, partly broken away and in section, corresponding to FIG. 5 and showing a modified form of my invention.

In FIGS. 7–9, I show a modified form of my invention in which the latch element is in the form of a lever arm 49 which is pivotally connected intermediate its ends by a pivot pin 51 to a support bracket 52 which in turn is secured to the top panel 14 of the supporting frame 13 by a rivet 53. A conventional spring member, such as a torsion spring 54, surrounds the pivot pin 51 with end portions thereof engaging the inner surface of the lever arm 49 and the adjacent surface of the panel member 14 whereby the lower end of the lever arm 49 is urged inwardly toward the guide members 22.

As shown in FIG. 8, the lower end of the lever arm 49 carries a horizontal member 56 having spaced apart projections 57 which define a recess 58 for receiving the guide members 22, as described hereinabove. Also, as shown in FIG. 8, the inner surface of the horizontal member 56 has sloping surfaces 59 which are inclined inwardly toward the central portion of the horizontal member 56 whereby the member 56 is moved outwardly as the guide members 22 engage the same as the door assemblies 10 are moved toward closed position. After the door assemblies have been moved to fully closed position, the guide members 22 move within the confines of the recess 58 whereby the door assemblies 10 are retained in locked position until the lever arm 49 is released. This is accomplished by pressing inwardly on the upper end of the lever arm 49 whereby the lever arm rotates in a clockwise direction as viewed in FIG. 9 to thus move the projections 57 outwardly away from the guide members 22 whereupon the guide members 22 are then free to move out of alignment with the recess 58 as the door assemblies are moved toward open position. Accordingly, the upper end of the lever arm 49 defines a handle for releasing the latch element when it is desired to open the door assemblies.

The operation of the latch element shown in FIGS. 7–9 is substantially identical to the operation of the apparatus shown in FIGS. 1–6. That is, as the door assemblies 10 are moved toward closed position, the guide members 22 engage the inclined surfaces 59 to thus move the horizontal member 56 outwardly out of the path of movement of the guide members 22 whereby the guide members 22 move into alignment with the recess 58. The spring member 54 then returns the lever arm 49 and its horizontal member 56 to the locked position, as shown in FIGS. 8 and 9. The recess 58 thus secures the guide members 22 in the locked position until the upper end of the lever 49 is moved inwardly to release the guide members 22 for movement away from each other and toward open position.

From the foregoing description, it will be seen that I have devised an improved latch unit for a fire screen folding door assembly. By providing a latch unit which positively retains the folding door assembly in the extended, closed position, the doors cannot be opened accidentally and cannot be opened by a child due to the fact that the release mechanism for the latch element is not only out of reach of a child but must be moved inwardly with sufficient force to move the latch element to a position to release the guide members. Also, by mounting the latch element adjacent the inner edge of the innermost folding door, the latch element is adjacent the usual handles for folding door assemblies whereby the release mechanism and the door handles may be actuated with a minimum of effort. Furthermore, it will be seen that my improved latch unit for a fire screen folding door assembly is extremely simple of construction, economical of manufacture and one which may be readily assembled prior to sale.

While I have shown my invention in two forms, it will be obvious to those skilled in the art that it is not so limited, but is susceptible of various other changes and modifications without departing from the spirit thereof.

What I claim is:

1. In a latch for a fire screen folding door assembly hingedly mounted along an outer edge thereof within an opening in a supporting frame with the door assembly having at least two door panels hingedly connected in edge to edge relationship with a generally vertically projecting guide member adjacent the inner edge of the door assembly adapted to move in a horizontal guideway in the frame as the door assembly is moved selectively to an open folded position and to an extended closed position, (a) a movable latch element comprising an elongated spring member carried by said frame adjacent the position of said guide member while said door assembly is in said extended closed position and adapted for movement selectively to a first position in the path of movement of said guide member and to a second position out of the path of movement of said guide member and having end portions extending at an angle toward said supporting frame so that said latch element is urged by said end portions toward said first position, (b) said spring member resiliently maintaining said first position until said guide member engages said latch element and moves said latch element to said second position in response to movement of said door assembly toward said extended closed position, (c) an offset portion intermediate the ends of said elongated spring member defining a recess in said latch element in position to receive said guide member upon movement of said door assembly to said extended closed position so that said latch element returns to said first position and secures said door assembly in said extended closed position with there being a recess in said frame for receiving said offset portion upon movement of said latch element to said second position, and (d) an actuator member operatively connected to said latch element for moving said latch element to said second position to release said guide member for movement relative to said latch element.

2. A latch for a fire screen folding door assembly as defined in claim 1 in which said elongated spring member is a leaf spring.

3. A latch for a fire screen folding door assembly as defined in claim 1 in which said actuator member comprises:

(a) a movable member having a portion thereof interposed between the rear side of said frame and said offset portion in position to engage said offset portion and move said latch element to said second position, and (b) a handle operatively connected to said movable member.

4. A latch for a fire screen folding door assembly as defined in claim 3 in which said movable member is a leaf spring anchored at one end to said frame with the other end thereof extending between said frame and said offset portion with said other end being urged toward said frame.

* * * * *